US005616037A

United States Patent [19]

Lorraine et al.

[11] Patent Number: 5,616,037

[45] Date of Patent: Apr. 1, 1997

[54] FUEL RAIL WITH COMBINED ELECTRICAL CONNECTOR AND FUEL INJECTOR RETAINER

[75] Inventors: Jack R. Lorraine, Newport News, Va.; John Smith, Watuaga, Tenn.

[73] Assignee: Siemens Automotive Corporation, Auburn Hills, Mich.

[21] Appl. No.: 511,386

[22] Filed: Aug. 4, 1995

[51] Int. Cl.[6] ..... F02M 51/00

[52] U.S. Cl. ..... 439/130; 123/456

[58] Field of Search ..... 439/130; 123/456, 123/470, 472, 468

[56] References Cited

U.S. PATENT DOCUMENTS

| | | | |
|---|---|---|---|
| 5,030,116 | 7/1991 | Sakai et al. | 123/456 |
| 5,127,382 | 7/1992 | Imoehl | 123/470 |
| 5,131,857 | 7/1992 | Gmelin et al. | 123/456 |
| 5,203,304 | 4/1993 | Hafner et al. | 123/456 |
| 5,323,749 | 6/1994 | Gras et al. | 123/470 |

*Primary Examiner*—Gary F. Paumen
*Attorney, Agent, or Firm*—Russel C. Wells

[57] ABSTRACT

A fuel rail has a series of contact strips extending along each side of a molded plastic inner fuel rail, each contact strip having a hook shaped end engaging a contact pocket in a fuel injector to establish an electrical connection. Oppositely located pairs of hook ends retain each fuel injector within a seat in the fuel rail. An overmold over the fuel rail encloses the inner fuel rail and the contact strips, and is formed with openings, each receiving an injector which is hermetically sealed therein.

13 Claims, 2 Drawing Sheets

ENGINE CONTROLS
12
18
22
20
19
16
11
10
14

30
34
28
32
27
26
24

40
38
36

FUEL RAIL WITH COMBINED ELECTRICAL CONNECTOR AND FUEL INJECTOR RETAINER

BACKGROUND OF THE INVENTION

This invention concerns fuel injectors for internal combustion engines, and more particularly for connecting the fuel injectors to an electronic controller. The fuel injectors are mounted in a fuel rail comprising a hollow tube supplied with fuel under pressure. The injectors are each received in a seat in the rail and held therein with a suitable retainer.

Pressurized fuel is communicated to the injectors so that when an injector valve is opened, fuel is sprayed into an air intake manifold adjacent the intake valve (or valves) of the engine. The valve is operated by a solenoid coil housed in the injector and energized via electrical leads extending between a connector associated with each injector and the electronic controller.

In some designs, the electrical connections and solenoid are immersed in fuel, which protects them from the atmosphere which could otherwise over time degrade the quality of the electrical contacts.

However, some fuels are corrosive and neither the solenoid nor the connections can be exposed to such fuels.

In the past, separate electrical connectors have been associated with each injector for connecting a respective set of electrical leads to the electronic controller.

The leads and connectors are disadvantageously exposed in many designs, and installation of the electrical leads constitutes an assembly process in addition to securement of the injectors in their fuel rail seats. The connectors are located intermediate the length of the associated injector, and each contact pin must be hermetically sealed to protect against atmospheric corrosion tending to deteriorate the quality of the electrical connection. In addition, the connector body must be sealed at either end to the injector body.

U.S. Pat. No. 5,127,382 issued on Jul. 7, 1992 for an "Electrical Connector Bar for a Fuel Injector/Fuel Rail Assembly and Method of Making" describes a connector bar which encloses the electrical connections for a series of fuel injectors.

The object of the present invention is to provide an arrangement for enclosing electrical contacts for a series of fuel injectors which does not expose the electrical connections to the fuel nor to the atmosphere, and eliminates the need for hermetic sealing of the individual contacts at the injectors, as well as to simplify the sealing of the connector as a whole. The arrangement also includes a retainer for holding each of the injectors to the fuel rail, such that the electrical connections are made at the same time the injectors are assembled to the fuel rail to simplify installation of the injectors and electrical connections.

SUMMARY OF THE INVENTION

The above recited object is achieved by arranging a series of conductor strips extending along either side of a molded inner fuel rail, a set of control signal conductor strips on one side provided for a control signal for each respective injector, and a common conductor strip extending along the other side.

Each control signal conductor strip has a contact segment at one end extending downward along a respective projecting injector seat, with a reversely formed inwardly facing hook end, while the common contact strip also has a plurality of downwardly extending, reversely formed inwardly facing hook ends. The hook ends protrude inwardly through windows in the injector seats.

The injectors are received in seats molded into the fuel rail, and each injector has oppositely located contact pockets which are snap fit to the contact strip hook ends, which engagement thereby simultaneously establishes the electrical connection and well as engaging one edge of engagement securing the injector in its fuel rail seat.

An overmold is formed to encapsulate the inner fuel rail and conductor strips, holding and sealing the same against the fuel rail. Cylindrical protuberances are formed by project from the overmold extending over the injector seats, and the injectors are hermetically sealed at openings into the seats to protect the electrical contacts, with a fuel seal provided for each injector adjacent the fuel passage in the inner rail.

DETAILED DESCRIPTION

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Figures 1, 2, 3, 4:
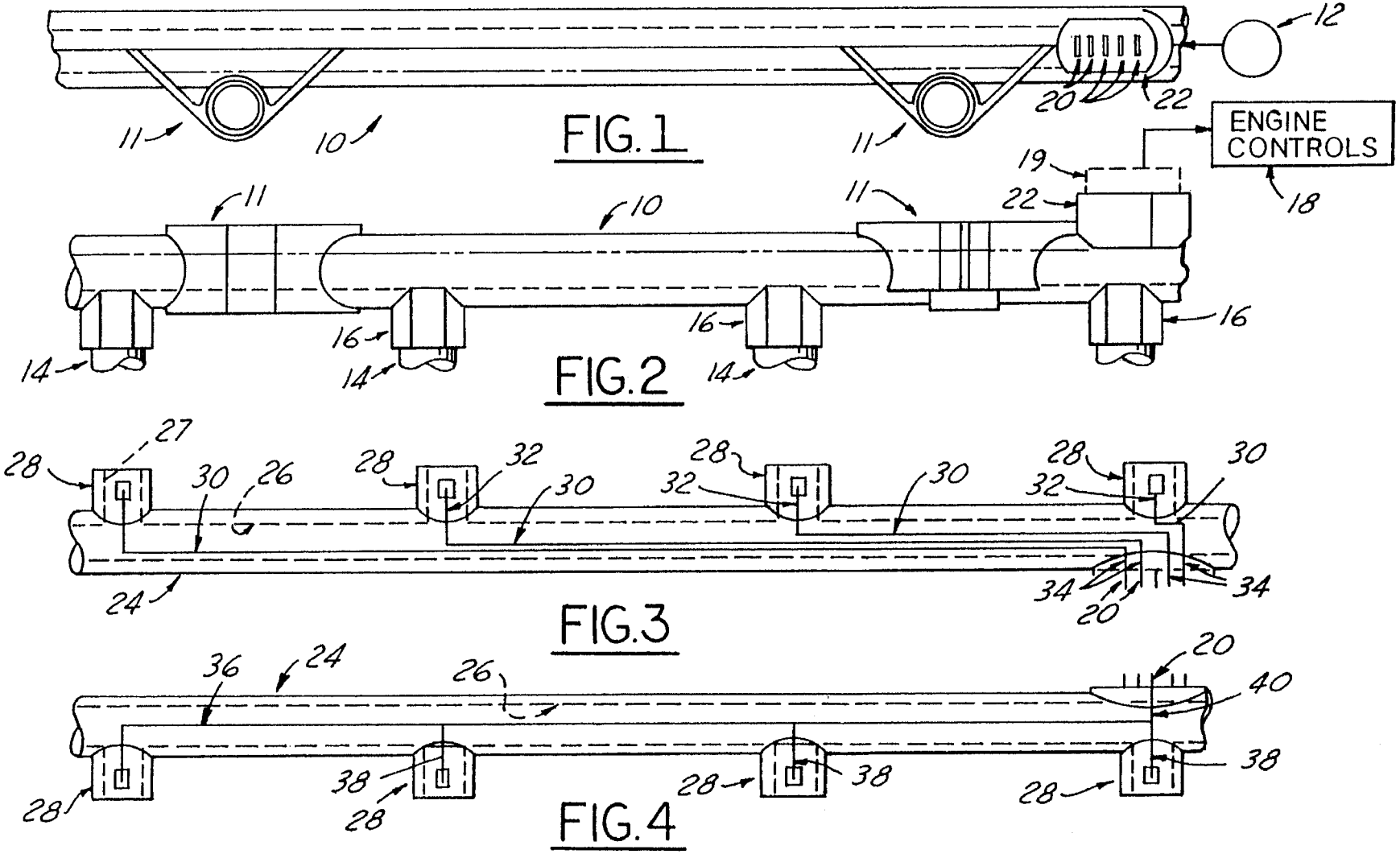
FIG. 1 is a fragmentary top view of a fuel rail assembly constructed according to the present invention.
FIG. 2 is a fragmentary side view of the fuel rail assembly shown in FIG. 1.
FIG. 3 is a fragmentary side view of an inner molded fuel rail incorporated in the fuel rail of FIG. 1.
FIG. 4 is a fragmentary reverse side view of the inner molded fuel rail incorporated in the fuel rail of FIG. 1.

Referring to the drawings and particularly FIGS. 1 and 2, fuel rail assembly 10 comprises an elongated member integrally formed with mounting brackets 11 having an internal passage adapted to be supplied with fuel under regulated pressure from a source 12. Various pump-regulator devices and arrangements are well known in the art.

The pressurized fuel is communicated to a series of injectors 14 (shown in fragmentary form) having one end received in injector seats 16 formed at spaced locations along the length of the fuel rail 10.

The other end of each injector 14 is adapted to be inserted into an air flow manifold (not shown) so that fuel from each injector is controllably injected into the engine upon opening of each injector valve, operated by a solenoid in the manner well known in the art.

Electrical control signals are transmitted from engine controls 18 to each injector 14 by an arrangement included in the present invention, comprising an electrical connector 19 having sockets receiving contact pins 20 arrayed within a connector seat 22 integrally formed in the fuel rail 10.

The fuel rail 10 is of molded plastic construction, the molding taking place in two stages.

An inner rail 24 is molded first (FIGS. 3, 4) defining the fuel passage 26 which provides fuel flow to cross passages 27 to inner injector seats 28.

Switching conductor strips 30 are fit to one side of the inner rail 24, with a respective one connected to a contact segment 32 extending to one side of a respective injector seat, and a pin connector segment 34 extending to a respective pin contact 20.

A single common conductor strip 36 is fit to the opposite side of the inner fuel rail 24 extending along the length thereof.

A plurality of contact segments 38 extend from the conductor strip 36, to the other side of a respective inner injector seat 28.

A pin connector segment 40 connects strip 36 to one of the connector pins 20.

Figure 5:
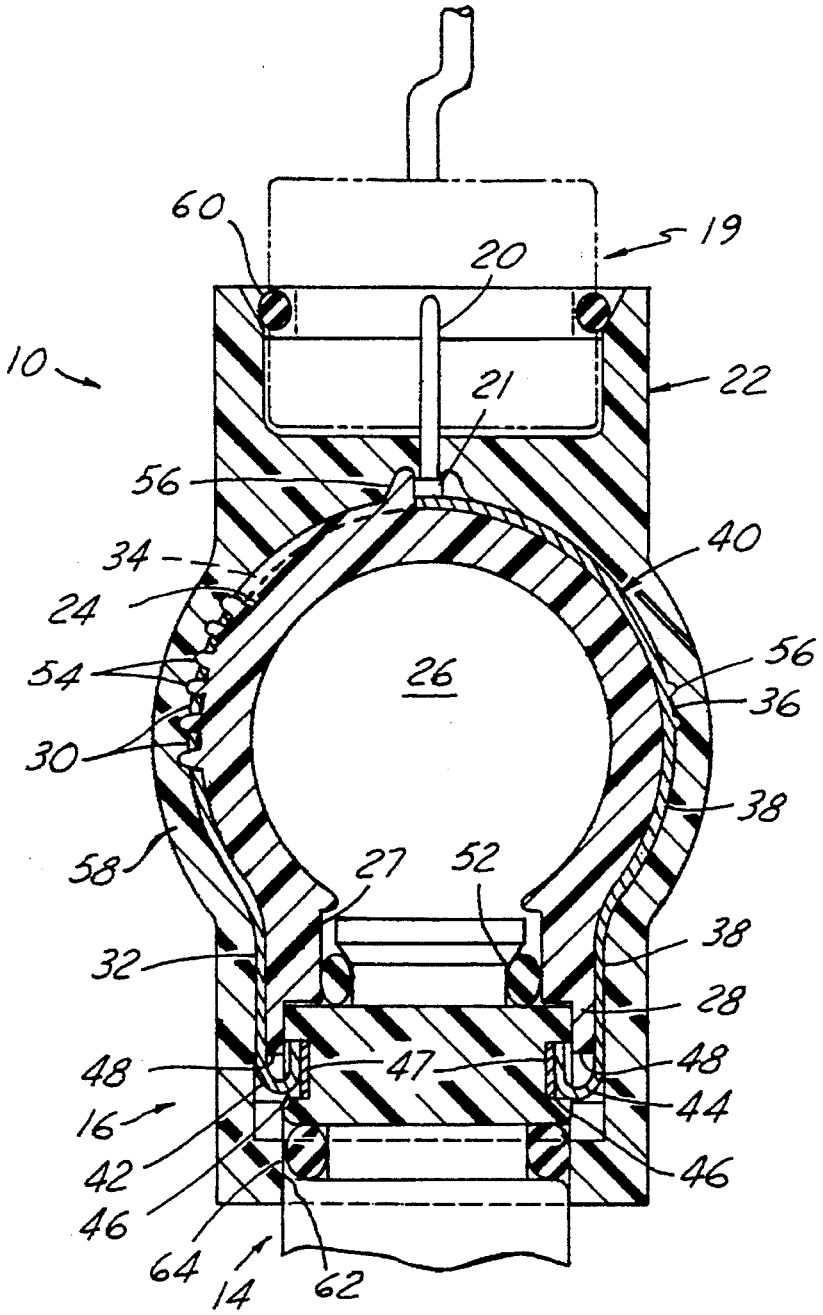
FIG. 5 is an enlarged transverse sectional view taken through the fuel rail of FIG. 1.
Figure 5A:
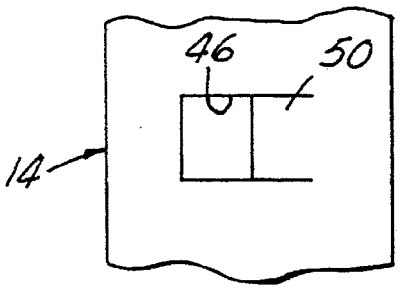
FIG. 5A is a fragmentary view of an injector showing a contact pocket and ramping surface.

FIG. 5 shows additional details, including the shaping of contact segments 32 and 38 with inwardly facing hook ends 42, 44 which are received in respective diametrically opposite pockets 46 formed in the body of the injector 14. Electrical contacts 47 are disposed in each pocket 46, both connected to the injector solenoid by internal wiring leads, not shown.

Diametrically opposite windows 48 are molded into the inner injector seats 28, allowing the hook ends 42, 44 to extend in from the outside surface of the inner rail 24 and into the pockets of an injector 14 when the injector 14 is installed in an inner seat 28.

The injectors 14 are preferably installed by rotating the pockets 46 into alignment with windows 48, after fully inserting each injector 14 to bring the pockets 46 into alignment with the windows 48 and allow the hook ends 42 to snap into the pockets 46. The hook ends 42 engage the upper pocket edge to act as retainers holding the respective injector 14 in its seat, such that the electrical connections and installation are completed by the insertion and rotation of the injector 14.

A fuel resistant seal 52 is provided on injectors 14, sealing against the inside of cross passages 27 as shown to isolate the contacts from the fuel.

A ramping surface 50 adjacent each pocket allows the hook ends 42 to be cammed out of the pockets 46 when removing the injectors 14 by rotation of the injector.

The contact pins 20 have broadened heads 21 and are snapped into spaced tabs 56 molded into the top of one end of the fuel rail 24, slots allowing insertion of an end of each respective contact segment 34, 40 to establish an electrical connection thereto.

An outer overmold 58 is molded over the inner rail 24, to thereby encapsulate the inner rail 24, mechanically securing the contact strips 30, 36, contact segments 32, 38, pin connector segments 34, 40, and the base of pin contacts 20, as well as isolating these elements from the atmosphere.

The overmold 58 is of a suitable plastic, but need not be of a plastic which is fuel resistant as the inner rail 24 must be, since it is not exposed to fuel.

The overmold 58 forms the connector seat 22 and the socket connector 19 received therein is provided with a hermetic seal 60 to isolate the protruding portion of the pin contacts 20 from the atmosphere.

The overmold 58 extends over the inner injector seats 38 to form the completed injector seats 16, with an aligned opening 62 receiving the injector 14. A hermetic seal isolates the contact seats 47 and hook ends 42 from the atmosphere to prevent degradation over time of the quality of the electrical connection.

The sealing required is simplified as the individual contacts are enclosed within the overmold 58, with only a pair of hermetic seals 60, 62 required.

Installation of the injectors is simplified and separate wiring covers and harnesses are not needed.

Since the electrical connections and solenoid are not exposed to fuel, hence this arrangement can be used with corrosive fuels.

We claim:

1. An electrical connector and fuel injector retainer arrangement of a fuel rail assembly, comprising:

an inner fuel rail for a plurality of fuel injectors, each injector adapted to be positioned within a respective one of a series of injector seats formed along said inner fuel rail;

a series of electrical conductor strips extending along one side of said inner fuel rail, and a common connector strip extending along another side of said inner fuel rail, each conductor strip having a contact segment extending downwardly to a respective fuel injector seat, and an array of connector contacts projecting from said fuel rail, each connector contact connected to a respective one of said conductor strips and adapted to mate with an external connector adapted to provide a connection to external controls for said injectors;

each fuel injector having a contact on opposite sides thereof with each contact engaged by an end of a respective contact segment to electrically connect each of said fuel injectors to said external connector contacts, wherein each of said contact segments are reversely shaped to form a hook end, a contact pocket located on opposite sides of each of said fuel injectors, an edge of said hook end hooked within a contact pocket of an associated fuel injector to hold said fuel injector, whereby each is retained in said fuel rail seat.

2. The arrangement according to claim 1, further including an overmold of molded plastic encasing said inner fuel rail and said conductor strips.

3. The arrangement according to claim 2, wherein said inner fuel rail is constructed of molded plastic resistant to fuel and wherein said overmold plastic is of a different composition.

4. The arrangement according to claim 1 further including a ramp surface on each fuel injector adjacent each pocket, adapted to engage a respective hook end engaged with said fuel injector and cam the same out of a respective contact recess on said fuel injector as said fuel injector is rotated.

5. The arrangement according to claim 1 wherein said connector contacts comprise pins, and further including a single socket connector mating with each of said pin contacts.

6. The arrangement according to claim 2 wherein said overmold encases each of said fuel rail injector seats, and has an opening at the outer end of each seat allowing insertion of said fuel injector, and further including a hermetic seal for each fuel injector mounted within said opening.

7. The arrangement according to claim 6 further including a fuel seal for each fuel injector located so as to prevent fuel from reaching said hook ends and fuel injector pocket contacts.

8. The arrangement according to claim 1 wherein each fuel injector is formed with a ramp surface adjacent each pocket enabling camming out a respective hook end upon rotation of each fuel injector.

9. A method of constructing a fuel rail comprising the steps of:

molding an elongated inner fuel rail defining a fuel passage and cross passages defining seats for receiving respective fuel injectors;

said inner fuel rail, each conductive strip having a contact segment extending into a respective fuel injector seat, each conductive strip extending from a respective contact segment to a corresponding connector contact fixed to encasing said inner rail and conductive strips by molding an overmolding over said inner rail.

10. The method of claim 9 further including the step of forming an opening in said overmold aligned with each cross passage and configured to receive a fuel injector inserted therein, and further including the step of installing a fuel injector therein and hermetically sealing each of said fuel injectors to said overmold at a respective opening.

11. The method of claim 9 further including the step of forming a hook end on each contact segment, and forming a contact pocket on a series of fuel injectors so that said hook ends snap fit into an opposing set of contact pockets upon being inserted in a respective fuel injector seat to be retained therein and to establish an electrical connection to a respective conductive strip.

12. The method of claim 9 wherein in said step of molding said overmolding, said connector contacts project through said overmolding.

13. The method of claim 9 wherein said inner rail is molded from a fuel resistant plastic and said overmolding is molded from a plastic not resistant to fuel.

* * * * *